US007862668B1

(12) United States Patent
Hildebrandt et al.

(10) Patent No.: US 7,862,668 B1
(45) Date of Patent: Jan. 4, 2011

(54) SINGLE-BASE PROPELLANT COMPOSITION USING BUNENA AS ENERGETIC PLASTICIZER

(75) Inventors: Floyd J. Hildebrandt, Montclair, NJ (US); Scott Hildebrandt, legal representative, Montclair, NJ (US); Ronald L. Simmons, Lawrence, KS (US); Carol Simmons, legal representative, Lawrence, KS (US); Thelma G. Manning, Montville, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 156 days.

(21) Appl. No.: 10/711,651

(22) Filed: Sep. 29, 2004

(51) Int. Cl.
*C06B 45/10* (2006.01)
*C06B 31/52* (2006.01)

(52) U.S. Cl. ..... 149/19.8; 149/49

(58) Field of Classification Search ..... 149/19.8, 149/49
See application file for complete search history.

(56) References Cited

U.S. PATENT DOCUMENTS 5,507,893 A * 4/1996 Mullay et al. ..... 149/76
5,602,361 A * 2/1997 Hamilton et al. ..... 102/288
6,228,192 B1 * 5/2001 Neidert et al. ..... 149/19.8
6,607,618 B1 * 8/2003 Manning et al. ..... 149/45

* cited by examiner

*Primary Examiner*—Aileen Felton
(74) *Attorney, Agent, or Firm*—Henry S. Goldfine

(57) ABSTRACT

A gun propellant formulation comprising: a nitrocellulose component comprising from about sixty-five percent (65.0%) to about ninety-five (95.0%) of the gun propellant by weight, having a nitrogen proportion of substantially twelve and six-tenths percent (12.6%) nitrogen; an energetic plasticizer component comprising from about 5.0 percent (5.0%) to about 35 percent (35.0%) of the gun propellant by weight, and comprising N-Butyl-2Nitratoethyl Nitramine (BuNena); a burning rate moderator and stabilizer component comprising from about one-half of one percent (0.5%) to about five percent (5.0%) of the gun propellant by weight, and comprising Sym-Diethyl Diphenyl Urea, N,N'-Diethyl Carbanilide (Ethyl Centralite, Centralite I); and a stabilizer component comprising about one-half of one percent (0.5%) to about five percent (5.0) of the gun propellant by weight, and comprising Acetyl triethyl citrate (ATEC). Additional components comprising less than 5% of the gun propellant may optionally include Graphite, carbon black, and candelilla wax.

1 Claim, No Drawings

SINGLE-BASE PROPELLANT COMPOSITION USING BUNENA AS ENERGETIC PLASTICIZER

FEDERAL RESEARCH STATEMENT

The invention described herein may be made, used, or licensed by or for the United States Government for government purposes without payment of any royalties thereon or therefore.

BACKGROUND OF THE INVENTION

1. Field of the Invention

This invention relates generally to the field of gun propellants and in particular it relates to a gun propellant that is environmentally friendly, and sufficiently insensitive such that the likelihood of unexpected, potentially catastrophic detonations is reduced or eliminated.

2. Description of Related Art

Many gun propellant compositions are manufactured with, or contain, various compounds that may be environmentally hazardous or even toxic. This is particularly true of certain munitions.

For example, current formulation of a number of a number of widely used gun propellants contains toxic and hazardous materials including dinitrotoluene (DNT), dibutylphthalate (DBP), and diphenylamine (DPA). Significantly, diphenylamine (DPA) is classified as a highly toxic material, dibutylphthalate (DBP) is a suspected carcinogen and—according to a study prepared by the United States Department of Health and Human Services—exposure to dinitrotoluene (DNT) is associated with an increased frequency of liver, bile duct and gall bladder cancers.

Removing these toxic and hazardous materials from the manufacture of gun propellants would therefore be a great improvement in the health and safety of workers preparing such munitions. Additionally, if certain solvents that are commonly used in the manufacturing process of gun propellants were eliminated, a number of environmental concerns would be eased. Accordingly, a new formulation that permits both the removal of hazardous and toxic components and eliminates the need for certain hazardous solvents in the manufacturing process would represent great progress in the art.

At the same time, there are other undesirable characteristics of current gun propellant formulations—such as its susceptibility to an unintended detonation resulting from a kinetic energy penetrator—that, if eliminated or made more desirable, would also represent a significant improvement in the art.

Accordingly, the development of gun propellant compositions that are energetically favorable which minimally impact the environment and are sufficiently insensitive to unintended detonation(s)—remains a significant unrealized objective of gun propellant development and is therefore the subject of the present invention.

SUMMARY OF THE INVENTION

We have developed a gun propellant formulation that does not contain hazardous ingredients, or particularly toxic components and which may be produced without the use of toxic or otherwise hazardous solvents. Additionally, our inventive formulation is advantageously less sensitive to kinetic energy penetration than present formulations, making it particularly well suited for use in training or other evaluation exercises.

According to a preferred embodiment of the present invention, we have developed a gun propellant formulation comprising:

- a nitrocellulose component comprising from about sixty-five percent (65.0%) to about ninety-five (95.0%) of the gun propellant by weight, having a nitrogen proportion of substantially twelve and six-tenths percent (12.6%) nitrogen;
- a energetic plasticizer component comprising from about 5.0 percent (5.0%) to about 35 percent (35.0%) of the gun propellant by weight, said energetic plasticizer component comprising N-Butyl-2-Nitratoethyl Nitramine (BuNENA);
- a burning rate moderator and stabilizer component comprising from about one-half of one percent (0.5%) to about five percent (5.0%) of the gun propellant by weight, and comprising Sym-Diethyl Diphenyl Urea, N,N'-Diethyl Carbanilide (Ethyl Centralite, Centralite I); and
- a stabilizer component comprising about one-half of one percent (0.5%) to about five percent (5.0) of the gun propellant by weight, and comprising Acetyl triethyl citrate (ATEC).

Additional components including graphite, carbon black, and candililla wax may optionally be added to improve its handling and/or manufacturability. Such additional components are generally between 0.1% and 5.0% of the overall propellant composition.

The other objects, features and advantages of the present invention will become more apparent in light of the following detailed description of a preferred embodiment thereof.

DETAILED DESCRIPTION OF THE PREFERRED EMBODIMENT

Our novel gun propellant, which is the subject of the present invention, is both a "green" propellant and an "insensitive" munitions (IM).

Advantageously, it is considered a green propellant in that it contains no known hazardous and toxic substances. Consequently our inventive gun propellant represents a major step forward in the art when considering production workers who prepare the gun propellant or those who contact the propellant after its preparation. Additionally, the "green" nature of the gun propellant benefits the environment as a whole—since propellant residue exists in the environment long after its use.

Of further advantage, is the insensitive munitions (IM) characteristic of our propellant. As can be appreciated by those skilled in the art, gun propellant such as this is oftentimes the subject of training or other "live-fire" exercises in which personnel actually use the gun propellant. Unfortunately, accidents occur in which live rounds containing gun propellant are mishandled or struck by objects having a high kinetic energy. It is extremely desirable in such occurrences that the live rounds which are struck do not detonate as such unintended detonation may result in a catastrophic loss of property or life.

Advantageously, our novel formulation of gun propellant is relatively insensitive to such detonations, thereby rendering it advantageous over the art for such training operations in which unintended detonations are increasingly possible.

We have achieved the above-mentioned characteristic advantages of our gun propellant formulation through the use of a relatively unique plasticizer, N-Butyl-2-Nitratoethyl Nitramine (BuNena). BuNena itself exhibits a number of useful characteristics and its use in our gun propellant formulation similarly affects the training rounds.

In particular, BuNena is energetic, meaning that it contributes energetically to the overall gun propellant. In addition, it plasticizes (colloids) the nitrocellulose polymer(s) into a relatively homogeneous mass. Furthermore, BuNena acts as a processing aid during manufacture and imparts improved mechanical properties to the gun propellant such as elasticity and flexibility and lastly—but of great importance—it imparts the IM properties to the gun propellant.

Importantly, and in summary, BuNena can provide comparable performance at the same time providing a gun propellant with reduced sensitivity.

As can be readily appreciated by those skilled in the art, these seemingly mutually exclusive—but desirable—properties sharply contrast the properties provided by other, known plasticizers widely used in the art. In particular, plasticizers that are energetic tend to make the resulting gun propellant more sensitive. Conversely, plasticizers, which are not energetic—while their use may result in an insensitive munition—produce gun propellants exhibiting undesirable or insufficient energies.

BuNena—unlike other plasticizers used in the art—imparts an increase in energy and reduced sensitivity. It is officially classified as a flammable liquid and not an explosive.

The preparation of our novel munitions propellant proceeded as follows.

EXAMPLE PREPARATION

A nominal quantity of test formulation was prepared in the following manner. A quantity of alcohol-wet nitrocellulose having a Nitrogen content of twelve and six-tenths percent (12.6%) Nitrogen was worked in the presence of solvents to loosen the nitrocellulose fibers and stored to keep the water content uniform. A variety of solvents, including Acetone, Ethyl Acetate and DiEthyl-Ether are all satisfactory solvents for this working and generally comprise 40%-60% by weight. Various factors such as flammability may contribute to the decision of which particular solvent is chosen.

It should be noted at this point that the nitrocellulose used need not be a single purity. In particular, a blend (cotton lint blend) of nitrocellulose may be used with satisfactory results. More particularly, a blend of nitrocellulose, for example a blend of 13.15% Nitrogen Nitrocellulose and 11.3% Nitrogen Nitrocellulose is satisfactory. Other blends would likely work as well so long as the overall Nitrogen is substantially 12.6%.

Returning now to our formulation, other materials were prepared as follows. A pre-dissolved plasticizer/stabilizer mixture was made with the following components: BuNena, and Acetyl Tri-Ethyl Citrate (ATEC) diethyl diphenyl urea which is otherwise known in the trade as Ethyl Centralite (EC).

The nitrocellulose was added to a sigma blade mixer. To this, the previously prepared plasticizer/stabilizer mixture was added and the combined materials were mixed together.

The resulting paste was extruded in a ram press, cut into granules, and allowed to dry and "flash off" substantial residual solvents by drying for approximately one (1) day at room temperature and approximately three (3) days at about 120 degrees Fahrenheit.

Of course, it will be understood by those skilled in the art that the foregoing is merely illustrative of the principles of this invention, and that various modifications can be made by those skilled in the art without departing from the scope and spirit of the invention. In particular, different components—particularly those that impart further desirable mechanical characteristics to the finished gun propellant—may be added to the list of ingredients. In particular, graphite—a conductive powder—may be added in small quantities (i.e., between 0.1 and 5%) to further improve the insensitivity of the munitions propellant to electrostatic discharge. In addition, components such as Potassium Sulfate may be added, to further reduce muzzle flash of a detonated round containing the munitions propellant. Such additions of components imparting further well-known characteristics are envisioned. Accordingly, my invention is to be limited only by the scope of the claims attached hereto.

What is claimed is:

1. A gun propellant formulation consisting of:

an alcohol-wet nitrocellulose component consisting of about 65% to about 95% of the propellant by weight, said nitrocellulose component having a Nitrogen proportion of substantially 12.6% Nitrogen, where said nitrocellulose component is a combination of a first nitrocellulose composition having a nitrogen proportion of 13.4% Nitrogen and a second nitrocellulose composition having a Nitrogen proportion of 11.3% Nitrogen, such that the combination has a Nitrogen proportion of 12.6% Nitrogen;

an energetic plasticizer component consisting of about 5% of the propellant by weight, said energetic plasticizer component consisting of N-Butyl-2-Nitratoethyl Nitramine (BuNena);

a burning rate moderator and stabilizer component consisting of about 0.5% to about 5% of the propellant by weight, wherein the burning rate moderator and stabilizer component is Ethyl Centralite;

a stabilizer consisting of about 0.5% to about 5% of the propellant by weight, said stabilizer consisting of Acetyl triethyl citrate (ATEC);

whereby, said formulation provides an insensitive gun propellant.

* * * * *